United States Patent [19]

Edleson

[11] 4,388,869

[45] Jun. 21, 1983

[54] ROTATING ROD WARHEAD

[75] Inventor: Stuart K. Edleson, Dallas, Tex.

[73] Assignee: The United States of America as represented by the Secretary of the Navy, Washington, D.C.

[21] Appl. No.: 626,655

[22] Filed: Mar. 22, 1967

[51] Int. Cl.[3] ..... F42B 13/48

[52] U.S. Cl. ..... 102/494; 89/1 A; 102/491

[58] Field of Search ..... 102/7.2, 63, 89, 393, 102/394, 489, 491, 504; 89/1 A

[56] References Cited

U.S. PATENT DOCUMENTS

| | | | |
|---|---|---|---|
| 1,305,967 | 6/1919 | Hawks | 102/63 |
| 2,372,383 | 3/1945 | Lee | 102/63 |
| 2,476,973 | 7/1949 | Gillon | 102/7.2 X |
| 2,796,021 | 6/1957 | Berlin et al. | 102/7.2 |
| 3,093,072 | 6/1963 | Pigman | 102/7.2 |
| 3,098,447 | 7/1963 | Hosli | 244/3.23 |
| 3,222,675 | 12/1965 | Schwartz | 102/63 X |

*Primary Examiner*—Charles T. Jordan

*Attorney, Agent, or Firm*—Robert F. Beers; Joseph M. St. Amand

[57] ABSTRACT

A warhead consisting of a bundle of cylindrical pellets or rods disposed in a drum arrangement and means for rotating same to a speed having a given number of revolutions per unit of time, and a release actuator means for simultaneously releasing and dispersing the cylindrical rods in a uniformly distributed non-random screen of rods.

7 Claims, 3 Drawing Figures

ROTATING ROD WARHEAD

The invention herein described may be manufactured and used by or for the Government of the United States of America for governmental purposes without the payment of any royalties thereon or therefor.

This invention relates to defensive space interception systems and more particularly to a warhead, for a non-orbital satellite interceptor, which produces a relatively static cloud of pellets, strewn in the path of a space target. The target, colliding with these pellets at orbital speeds, will be penetrated and damaged by the hypervelocity impact of the pellets. It has been determined that pellets in the form of long slender cylindrical rods having their axes aligned with the relative collision velocity vector offer the maximum penetration of both thick and multiplate thin targets to provide maximum assurance of hypervelocity particle splatter through the target, for minimum pellet weight. It is an object of this invention to provide a warhead for rapidly erecting an expanding screen of pellets oriented in a uniform pattern.

Other objects and many of the attendant advantages of this invention will become readily appreciated as the same becomes better understood by reference to the following detailed description when considered in connection with the accompanying drawings wherein.

The rotating rod warhead of this invention is carried by a non-co-orbital interceptor vehicle to be used for effective destruction of a space target.

Figure 1:
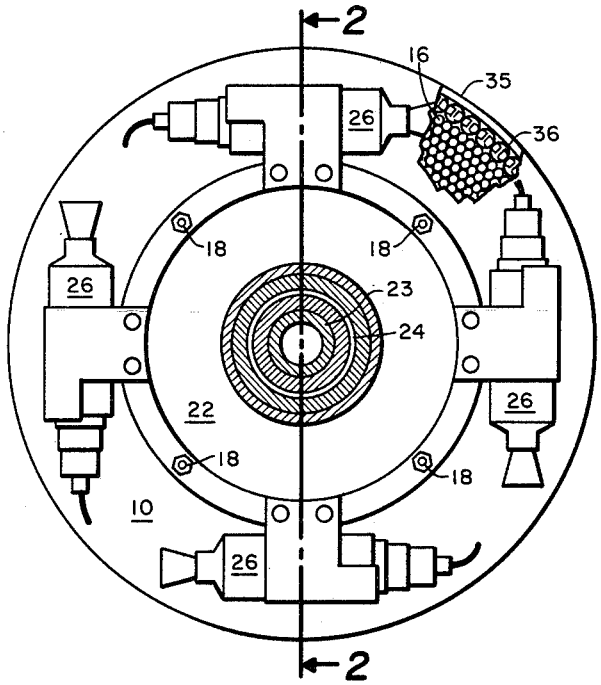
FIG. 1 is a partially cut-away view of a typical embodiment of the rotating rod warhead of this invention.
Figure 2:
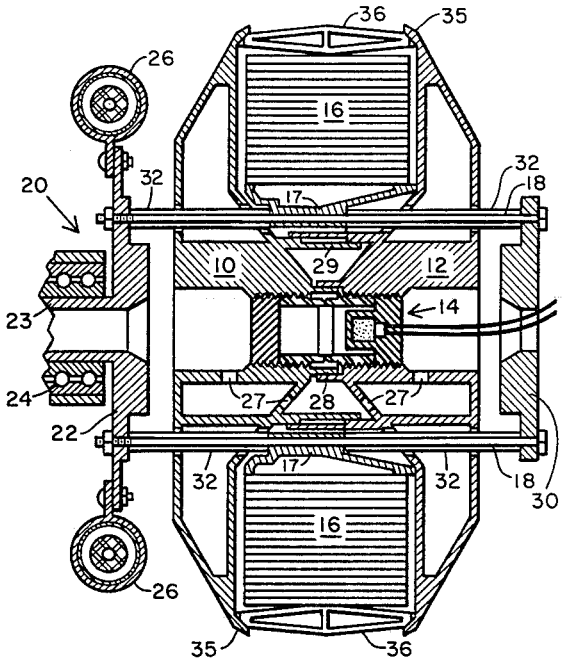
FIG. 2 is a cross-sectional view taken along line 2—2 of FIG. 1.

As shown in FIGS. 1 and 2, the device comprises two end plates 10 and 12 held together by means of a power cartridge 14, such as an explosive bolt or the like, to form a drum-shaped container or hub assembly for retaining a bundle of rod shaped pellets 16. Plates 10 and 12 are supported by a spool 17 on a plurality of rods 18 which are attached to drive means 20 for rotating the plates about their spin axes. Drive means 26, for example, may consist of a disc 22 having a central shaft 23 mounted in journaled bearings 24 and powered by several rocket type motors 26. Support rods 18 extend entirely through the assembly of plates, 10 and 12, and spool 17, as shown in FIG. 2. The ends of rods 18 opposite the ends attached to drive disc 22 are attached to a stop shield 30 which is spaced a given distance from end plate 12. End plate 10 is also spaced an equal distance, for example, from drive disc 22. Spacer sleeves 32, for example, which fit about support rods 18 and extend between spool 17 and drive disc 22 or shield 30 may be clamped to spool 17 and used to keep the hub assembly spaced from drive disc 22 and stop shield 30 respectively until detonation of power cartridge 14 which forces the plates apart. Stop shield 30 could be eliminated, if desired, or blown off with end plate 12 when power cartridge 14 is detonated. Slip joints 28 and 29 assure proper alignment of end plates 10 and 12, and restraint means may be provided to prevent rebound of plate 10 from disc 22 if desired.

The annular bundle of rod shaped pellets 16 are supported by spool 17 and retained within the drum-shaped container assembly, for instance, by means of retainer lips 35 about the circumference of end plates 10 and 12 and by a plurality of overlength pellet rods or rocker beams 36 positioned about the outer circumference of the bundle of pellets. This suspension for pellets 16 permits unrestrained equal and opposite motion of end plates 10 and 12 when cartridge 14 is detonated.

Figure 3:
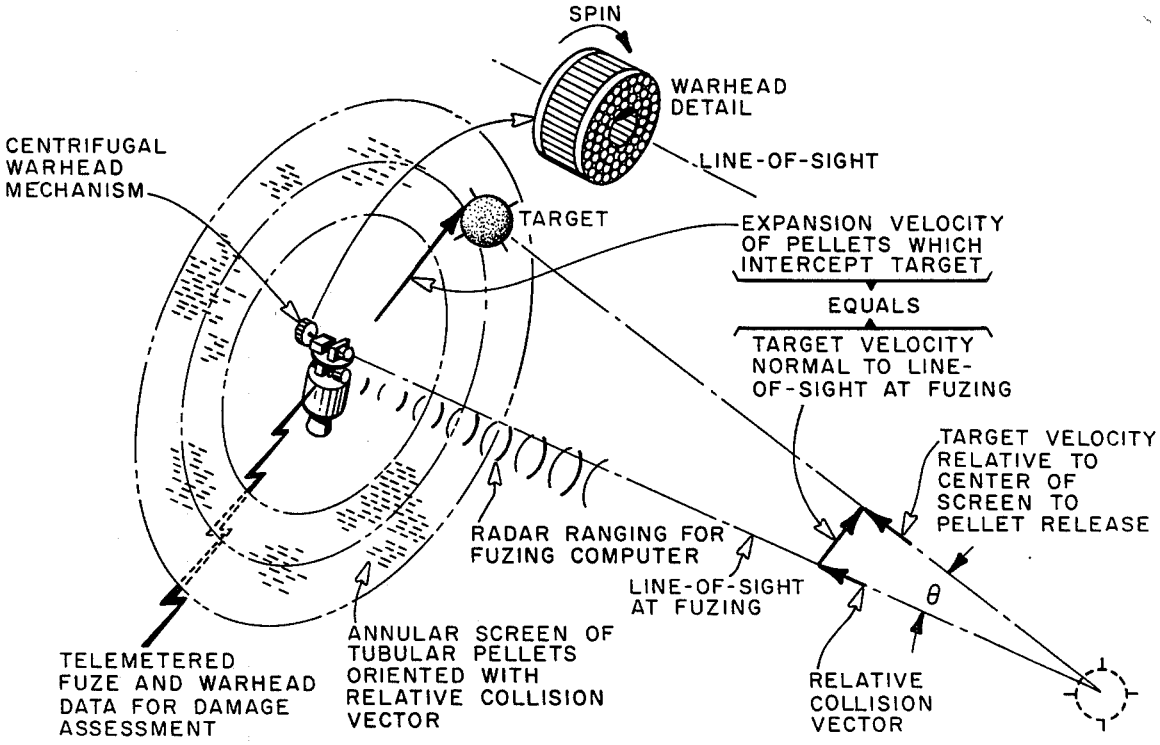
FIG. 3 is a diagrammatic illustration demonstrating the use and operation of the warhead of this invention.

Drive means 20 when activated is used to spin the drum-shaped assembly together with pellet rods 16 and 36 retained therein to a desired rotational speed suitable for dispersing the pellet rods when released to rapidly erect a screen in an expanding pattern of unconnected rods. Actuation of power cartridge 14 by fuzing signals will force plates 10 and 12 to separate. Plate 10 will be forced toward drive disc 22 and plate 12 will be forced toward stop shield 30. There is a complete absence of any explosion around the periphery of the end plates, thus eliminating any gases which could possibly perturb the pellets on their release. When the plates are separated, retaining lips 35 will release the pellet rods instantaneously, without perturbation, and the pellet rods will continue to spin about their long axes and maintain the same uniform pattern of the bundle with their long axes parallel to the spin axis of the bundle while expanding as a screen. If this spin axis is parallel to the line-of-sight to the target at the instant or release, those parallel rods which strike the target will be aligned with the relative collision velocity vector, as can be seen from FIG. 3.

To provide an expanding annular screen of oriented rods to intercept the target, plates 10 and 12 must be accelerated away from each other within, for example, several microseconds of time difference in starting, to maintain rod tip-off within acceptable limits. Where desirable, a rocker type of restraint beam 36 instead of a mere overlength pellet rod may be used to effectively restrain the bundle of rods 16 from their midpoints, to avoid any tip-off. Center point restraint of the pellet rods is highly desirable to equalize any differential forces tending to perturb the pellets at release. For perfect dispersion, the ends of all pellets in the bundle must be restrained in contact with one another until the radial acceleration is greater than the centripetal acceleration of the outermost pellet rod. Beams 36, restrained by lips 35, effectively maintain pellets rods 16 parallel to each other and to the spin axis of the drum-shaped assembly and provide adequate stability to keep the pellet rods thus aligned under various forces of spin-up and release. Beams 36 may be of any suitable design to maintain the pellet rods aligned parallel to and in contact with each other and the spin axis and to keep them from skewing.

Pellet rods may be of any suitable form; however, rods in the form of hollow cylindrical tubes provide better lethality for less weight. Obviously many modifications and variations of the present invention are possible in the light of the above teachings. It is therefore to be understood that within the scope of the appended claims the invention may be practiced otherwise than as specifically described.

What is claimed is:

1. A rotating rod warhead for rapidly erecting an expanding screen of pellets in a uniform pattern, comprising:

(a) two similar housing units connected together to form a substantially cylindrical shaped housing assembly, (b) a plurality of rod-shaped pellets retained within said cylindrical housing assembly for dispersing the pellets in a uniform pattern upon release thereof, said two housing units each having a circumferential retaining means thereabout for effectively retaining said pellets in a bundle within said housing parallel to each other and to the spin axis, (c) pellets positioned about the outer circumference of said bundle of pellets being longer than the others and in the form of rocker type restraint beams which hold the other pellets in restraint at a point midway between the ends thereof to equalize any differential forces tending to perturb the pellets during spin-up and at release, the ends of the restraint beams having their ends held by said circumferential retaining means, (d) drive means for spinning said housing assembly about its cylinder axis at a desired rotational speed for suitably dispersing said pellets upon their release, (e) actuator means for quickly separating said two housing units and releasing said pellets.

2. A device as in claim 1 wherein said pellets are retained within said housing parallel to each other and to the spin axis of the housing, and upon release therefrom will remain substantially oriented with their longitudinal axes parallel to said spin axis while dispersing to form an expanding screen of pellets.

3. A device as in claim 1 wherein said cylindrical housing forms an annular container for retaining said pellets in an annular bundle until released.

4. A device as in claim 1 wherein said rod-shaped pellets are in the form of hollow slender rods.

5. A device as in claim 1 wherein said actuator means comprises a detonator device for quickly separating said housing units on signal to release said pellets.

6. A device as in claim 5 wherein said detonator device is located in an area where upon actuation there will be an absence of any explosion around the cylindrical periphery of said housing units that could perturb said pellets on their release.

7. A device as in claim 1 wherein said housing units and pellets are supported on a spool means which permits unrestrained equal and opposite motion of the two housing units upon actuation of said actuator means for release of the pellets in a uniform pattern.

* * * * *